United States Patent [19]

Serafin et al.

[11] 4,109,860

[45] Aug. 29, 1978

[54] RAIL SPRING CLIP WITH TENSION LIMITING FEATURE

[75] Inventors: Marian A. Serafin, Paris; Maurice Decubber, Beaumont S. Oise, both of France

[73] Assignee: Societe Anonyme de Traverses en Beton Arme - Systeme Vagneux, France

[21] Appl. No.: 669,230

[22] Filed: Mar. 22, 1976

[30] Foreign Application Priority Data

Mar. 26, 1975 [FR] France ..... 75 09486

[51] Int. Cl.[2] ..... E01B 9/34

[52] U.S. Cl. ..... 238/349; 238/351

[58] Field of Search ..... 238/349, 351, 372, 310, 238/315, 338

[56] References Cited

U.S. PATENT DOCUMENTS

| | | | |
|---|---|---|---|
| 3,158,323 | 11/1964 | Sonneville | 238/349 X |
| 3,429,505 | 2/1969 | Newton | 238/349 |
| 3,429,506 | 2/1969 | Triplett | 238/349 X |
| 3,430,857 | 3/1969 | Matsubara et al. | 238/349 X |
| 3,458,132 | 7/1969 | Newton | 238/349 |
| 3,888,414 | 6/1975 | Duchemin | 238/310 |

FOREIGN PATENT DOCUMENTS

| | | | |
|---|---|---|---|
| 2,107,398 | 10/1971 | France | 238/349 |
| 2,239,560 | 7/1973 | France | 238/349 |
| 1,658,363 | 8/1969 | Fed. Rep. of Germany | 238/315 |
| 1,132,573 | 5/1961 | Fed. Rep. of Germany | 238/315 |
| 2,225,220 | 2/1973 | Fed. Rep. of Germany | 238/349 |

*Primary Examiner*—Drayton E. Hoffman
*Assistant Examiner*—Carl Rowold

[57] ABSTRACT

An assembly for securing a rail to a railway track sleeper of the type in which the rail is clamped on the sleeper by a resilient clip placed under stress by means of a nut screwed on a bolt associated with the sleeper. A bolt is provided with a shoulder which serves as an abutment to prevent undesired deformation of the resilient clip and/or the appearance of excessive extraction forces on the bolt when the nut is screwed down on the bolt. The bolt provided with a shoulder may be used with a variety of resilient clips.

6 Claims, 8 Drawing Figures

RAIL SPRING CLIP WITH TENSION LIMITING FEATURE

The present invention relates to railway tracks and in particular to the fixing of a rail to a railway track sleeper by measured (predetermined) tightening of a sleeper bolt, movable bolt or any other bolt.

Fixing arrangements have been known for a long time, comprising a resilient sleeper clip bearing firstly on the sleeper and secondly on the flange of a rail mounted on the sleeper, in which the tightening of the resilient clip takes place by means of a bolt associated with the sleeper and comprising a nut whose tightening causes the elastic clip to be placed under stress.

To illustrate the state of the art in this subject, it is possible to cite fixing assemblies produced by the Applicant and comprising a tightening clip of general U-shape, such as those described in particular in the U.S. Pat. No. 3,784,098 Jan. 8, 1974. Particular reference will be made to FIG. 2 of the French Certificate of Addition filed July 31, 1973 No. 7327958 (published under No. 2240959).

Resilient clips are also known, whereof of the vertical section is in the shape of a concave clip to form a loop.

Generally, the invention relates to all arrangements for securing a rail to a sleeper, in which an elastically deformable clip is placed under stress by screwing the nut of a bolt. It should also be stated that this bolt may be either rigidly fixed to the sleeper in a known assembly of the art, known by the name "sleeper bolt", or simply associated with the sleeper, with the possibility of relative movement for example in an assembly of the art known by the name "oscillating bolt".

In all assemblies of the aforesaid type, placing the resilient clip under stress by screwing the nut of the bolt causes the appearance of an extraction force (pulling out the bolt). On the other hand, in general, the tightening should not exceed a predetermined value, firstly so that it does not exceed the deformation capacity of the resilient clip and then so that it does not create excessive extraction forces on the bolt, which would present a danger of loosening it from the sleeper.

The tightening machines generally used for tightening clip systems comprise a torque limiter, or similar device, which in principle serves to prevent excess tightening, i.e. tightening exceeding the aforesaid predetermined value. But in practice, the use of these implements does not give complete satisfaction and it is frequently necessary to check the tightening rate by manual intervention, for example by means of a dynamometric key for example. When maintaining a railway track, manual interventions of this type are always necessary.

The present invention proposes a fixing assembly of the type in which the resilient clip is placed under stress by means of a fixed or moving bolt, in which means are provided in the construction, for preventing any possibility of excess tightening able to create inopportune deformations of the clip or excessive extraction forces on the bolt.

According to the invention, the bolt is provided with an abutment shoulder able to limit the tightening travel of the resilient clip along the axis of the bolt.

In the case where the bolt is integral with the sleeper, (sleeper bolt) its shoulder is advantageously used as a stop shoulder during assembly of the bolt on the sleeper.

Further features and advantages of the invention will become apparent from the ensuing description, referring to the accompanying drawings which relate to preferred embodiments of the invention.

In the accompanying drawings:

FIGS. 1*a* and 1*b* show in partial vertical section, the two end phases of tightening a fixing assembly previously proposed by the applicant (prior art);

FIG. 1*c* shows the variation of extraction force (withdrawal) to which the bolt of FIGS. 1*a* and 1*b* is subject, depending on the resilient tightening travel;

FIGS. 2*a*, 2*b* and 2*c* are counterparts of FIGS. 1*a*, 1*b*, 1*c* but for an arrangement improved according to the invention, in a first embodiment;

As far as possible, the same references are used for all the figures, to designate identical or similar parts of the various embodiments.

Figure 1A:
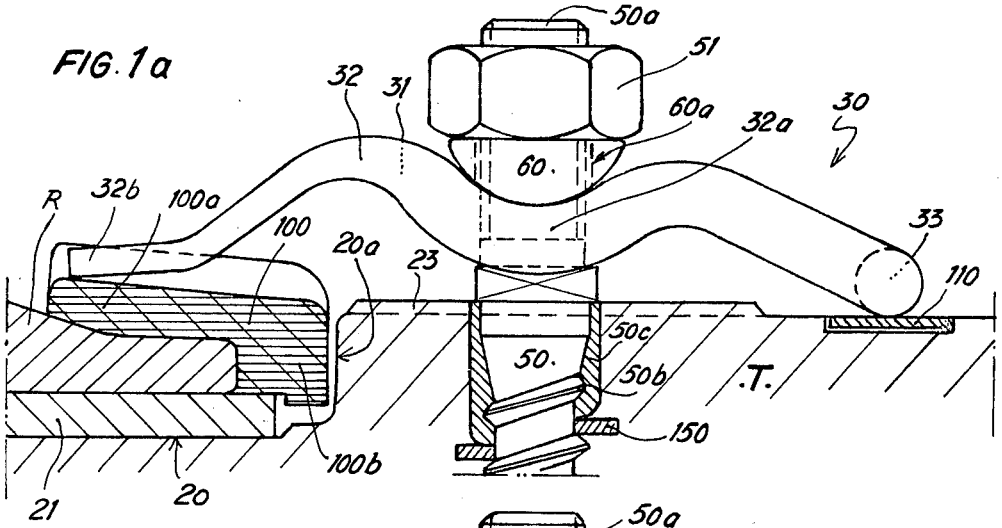
Figure 1B:
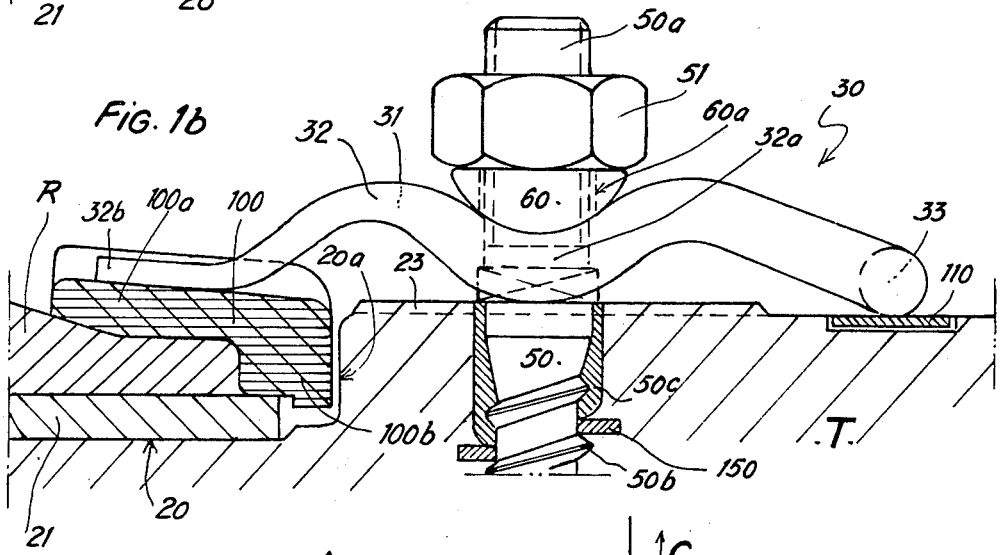

The resilient clip 30 of FIGS. 1*a* and 1*b* is of the type described in the said second Certificate of Addition No. 73 27958 This clip 30 is thus of general U-shape (plan view) and comprises two arms 31 and 32 connected by a base 33. In their central part, the arms comprise a concave part (31*a*, 32*a*). The height of the arms generally decreases from this concave part in the direction of their ends; whereas the arms preferably widen out simultaneously. The profile of the clip is in the form of an arc comprising a central curve (31*a*, 32*a*) surrounded by two counter-curves. The resilient clip 30 is used to secure a rail R to a sleeper T.

The rail R is mounted in a central recess 20 in the sleeper T by means of a resilient support plate 21, preferably an insulating plate. The central recess 20 in the sleeper is joined to a lateral plate 23 by a shoulder 20*a*.

FIGS. 1*a* and 1*b* show that the recess 20 is substantially of the same width as the base plate of the rail such that the shoulder 20*a* is close to the rail.

The sleeper is provided with a sleeper bolt 50 passing through the plate 23, at the screw-threaded end 50*a* of which engages a tightening nut 51. A tightening wedge 60 provided with a central bore 60*a* may be threaded on the end 50*a* of the bolt 50 and then be subject to the action of the tightening nut 51 in order to deform the clip 30.

An insulating wedge 100 comprises a substantially horizontal part 100*a* and a substantially vertical part 100*b*, such that the wedge closely surrounds the base plate of the rail R. The part 100*a* of the wedge 100 is substantially in contact with the shoulder 20*a* of the sleeper T, apart from the mounting clearance.

FIGS. 1*a* and 1*b* illustrate the tightening of the system.

At the beginning of tightening (FIG. 1*a*), the clip 30 is placed around the sleeper bolt 50, the ends 31*b*, 32*b* of its arms bearing against the part 100*a* of the wedge 100. The base 33 of the clip in turn bears against a support plate 110 fitted in the plate 23 of the sleeper. The head 60 is then threaded on the end 50*a* of the bolt 50 and the nut 51 is screwed on. The clip curves inwards and deforms progressively, the final position being illustrated in FIG. 1*b*. In this final position, the lower part of the ends 31*b*, 32*b* of the arms, the lower part of the incurved parts 31*a*, 32*a* as well as the lower part of the base 33 are located substantially in the same plane coinciding with the upper side of the plate 23, with which the clip is in contact by the lower part of its inwardly curved portions. So as not to overburden the drawings, the reference numerals 31*a* and 31*b* have not been shown, the latter would have coincided with the references 32*a* and 32*b*, since these similar parts of similar arms 31 and 32 are superimposed exactly on the drawings.

Figure 1C:
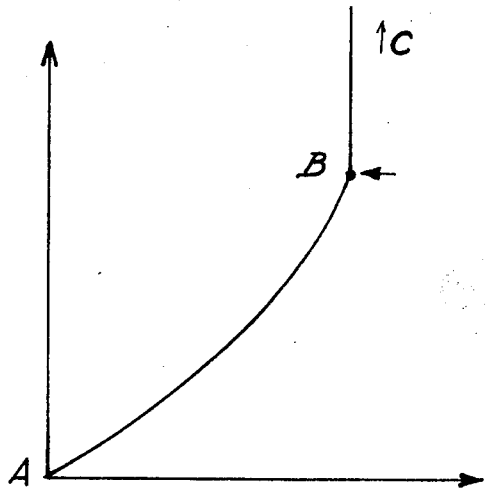

FIG. 1*c* illustrates the variation of the extraction force, to which the sleeper bolt is subjected depending on the flexion of the clip, the point A of the graph corresponding to the initial position of FIG. 1*a* and the point B to the final position of FIG. 1*b*.

The technical problem encountered with such an assembly of the prior art resides in the fact that when the position of FIG. 1*b* is reached, it is still possible to exert a tightening action on the nut 51 and this tightening force is translated by an increase in the extraction force of the sleeper bolt 50 from the sleeper, according to the curve B-C of FIG. 1*c*.

Thus, the attachment of the sleeper bolt may be damaged and the tightening arrangement made inoperative under the effect of accidental excess tightening of the nut 51.

Figure 2A:
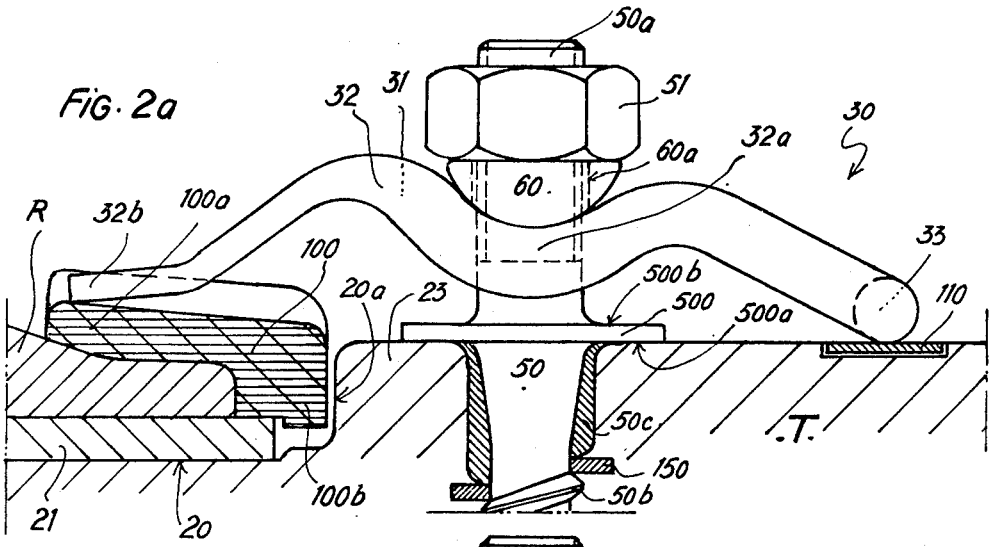
Figure 2B:
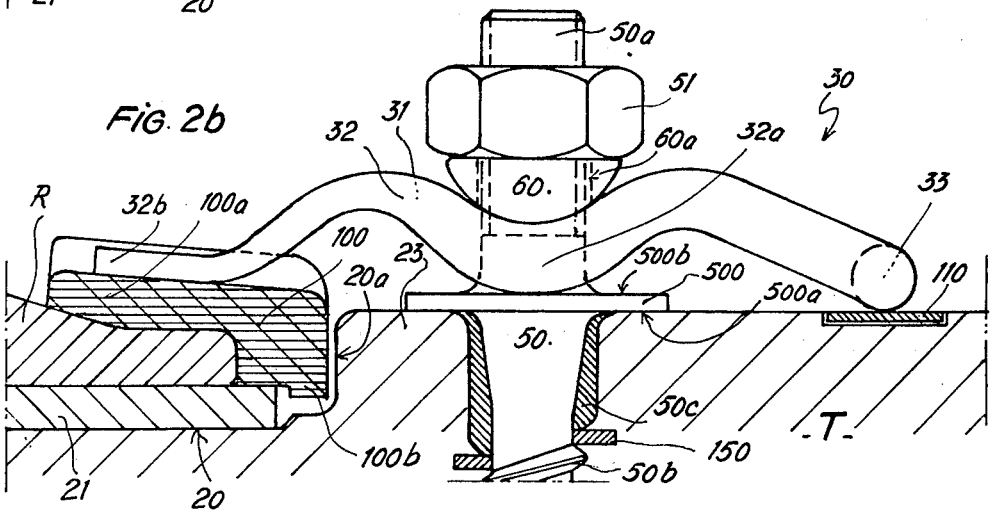
Figure 2C:
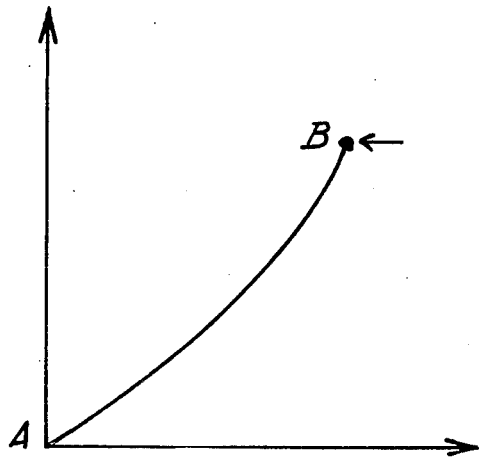

The invention remedies this serious drawback in a very simple and very effective manner, which is illustrated in FIGS. 2*a*, 2*b*, 2*c*, which are counterparts of FIGS. 1*a*, 1*b*, and 1*c*, but with respect to the improvement of the invention.

According to the invention, the sleeper bolt 50 is provided with an abutment shoulder 500. In the example illustrated in FIGS. 2*a* and 2*b* (first embodiment of the invention) this shoulder 500 is flush with the level of the plate 23, thus forming on its upper side 500*a* an arresting shoulder for the sleeper bolt 50, when it is positioned in the sleeper T. In manner known per se, the sleeper T, made from reinforced concrete for example, is provided with an opening intended to receive the sleeper bolt in the wall of which is inserted a metal packing 150 forming a helical metal thread (Thiollier packing). The sleeper bolt 50 comprises a screwthread 50*b* and this is thus screwed into the sleeper. The side 500*a* of the shoulder 500 serves as an arresting abutment against the plate 23 of the sleeper at the end of screwing. In this position, the sleeper bolt 50 is then made integral with the sleeper by adhesive 50*c* having great strength.

In a characteristic and essential manner, the shoulder 500 serves as a support on its side 500*b* for the central parts 31*a*, 32*a* of the clip 30, thus preventing the latter from bearing against the sleeper itself. Optimum tightening of the clip 30 is achieved (FIG. 2*b*) when the central parts 31*a*, 32*a* of the clip come into contact with the upper side 500*b* of the shoulder 500.

Thus, even in the case of accidental excess tightening, no extraction force can be transmitted to the sleeper bolt 50, which is greater than the compression force of the clip corresponding to the point B of the figure which, compared with FIG. 1*c*, clearly shows the results and advantages of the invention.

Figure 3:
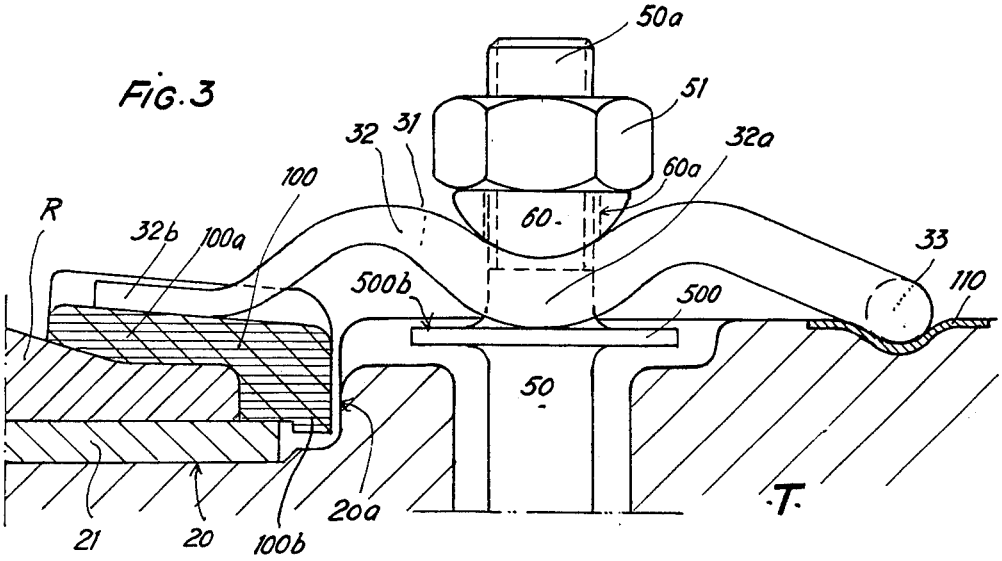
FIG. 3 shows a second embodiment of the invention in partial vertical section.

The invention has been described in the case of a sleeper bolt permanently fixed on a sleeper. It also relates to the case of an oscillating bolt of the type illustrated in FIG. 3. Naturally, in this case, the shoulder 500 solely fulfils its function as an abutment in order to limit the extraction force transmitted to the bolt, without serving as a shoulder for arresting the bolt, against the sleeper plate.

The application of the invention to a fixing assembly comprising a resilient clip (resilient sleeper clip) of the type designed and produced by the applicant has been described hitherto.

Nevertheless, it is clear that it relates to other types of resilient clips.

Figure 4:
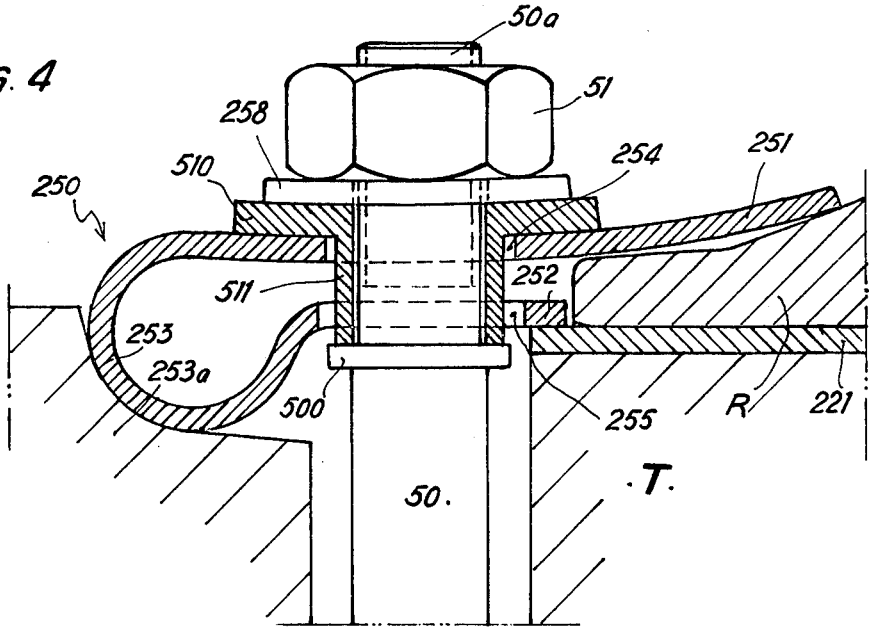
FIG. 4 shows a third embodiment of the invention also in partial vertical section.

FIG. 4 illustrates this possibility in vertical section. The clip 250 which is illustrated is in the form of a clip having two arms 251 and 252 connected by a loop 253 and provided with mounting holes 254, 255 respectively. The arm 251 rests on the flange of the rail R mounted on the sleeper T by means of a resilient support plate 221.

The loop 253 rests on a similar concave part 253*a* of the sleeper T. The bolt 50 is of the oscillating type.

According to the invention, the bolt 50, of the oscillating type, is provided as previously with a shoulder 500 and the nut 51 of the bolt 50 acts on a washer 510 provided with a cylindrical barrel 511 passing through the orifices 254 and 255 in the clip 250. Preferably, as shown, a plate 258 is interposed between the nut 51 and the washer 510.

It will be easily understood that the shoulder 500 serves as an abutment for the barrel 511 which abuts against the latter when the clip 250 reaches maximum tightening. The barrel may also be replaced by any spacing member able to be interposed between the shoulder 500 and the plate 258.

Possible over-tightening is absorbed by the barrel 511 without being re-transmitted to the bolt 50, in the form of an additional extraction force.

Naturally, the invention is not limited to the three embodiments described, but extends to all variations within its spirit.

What is claimed is:

1. An assembly for fixing a rail to a railway track sleeper, comprising a bolt having its lower portion embedded in the sleeper and threads on the upper portion thereof, a nut having threads in engagement with the threads of said bolt, a deformable resilient clip disposed around the bolt below said nut, said clip being an elongated member, one end of which engages the rail flange and the other end of which engages said sleeper, whereby tightening of said nut results in the downward deformation of said clip placing same under clamping stress and in the application of force on the rail by said clip to clamp said rail to said sleeper, a rigid shoulder on said bolt which serves as an abutment, said shoulder being of a size and positioned relative to said clip, rail and sleeper so that tightening of the nut results in said clip and shoulder contacting at a point which prevents any possibility of excess tightening able to create inopportune deformations of the clip or excessive extraction forces on said bolt while the clip provides sufficient clamping force.

2. An assembly according to claim 1, wherein the bolt is mounted to oscillate with respect to the sleeper.

3. An assembly according to claim 1, wherein the bolt is fixed with respect to the sleeper, and the lower side of said shoulder is shaped to enable the bolt to be supported on the sleeper during its assembly.

4. An assembly according to claim 1, wherein said shoulder co-operates in an abutment relationship with a spacer member of predetermined height in order to limit the deformation of the resilient clip in a direction parallel to the axis of the bolt.

5. An assembly according to claim 4, wherein the spacer member is a washer comprising a barrel portion.

6. An assembly according to claim 1 in which said shoulder cooperates with part of said clip in abutment relationship.

* * * * *